United States Patent [19]

Gamberini et al.

[11] Patent Number: 4,938,656

[45] Date of Patent: Jul. 3, 1990

[54] FEED EQUIPMENT FOR SUPPLYING A MACHINE UNIT WITH COMMODITIES ARRANGED IN SUBSTANTIALLY PARALLELEPIPED GROUPS

[75] Inventors: Antonio Gamberini, Bologna; Marco Brizzi, Zola Predosa, both of Italy

[73] Assignee: G.D. Societa per Azioni, Bologna, Italy

[21] Appl. No.: 251,397

[22] Filed: Sep. 30, 1988

[30] Foreign Application Priority Data

Oct. 2, 1987 [IT] Italy ..... 3626 A/87

[51] Int. Cl.[5] ..... B65G 60/00

[52] U.S. Cl. ..... 414/789.5; 414/790.3; 414/794.7; 414/797.8; 414/927; 53/157

[58] Field of Search ..... 414/789.5, 794.7, 790.3, 414/789.6, 797.8, 927; 53/157, 263

[56] References Cited

U.S. PATENT DOCUMENTS

| | | | |
|---|---|---|---|
| 1,721,552 | 7/1927 | Foernsler | 53/157 |
| 3,107,013 | 10/1963 | Euwe | 414/790.3 |
| 3,352,435 | 10/1966 | Reinecke | 414/794.7 |
| 3,392,851 | 7/1968 | Pearne et al. | 414/789.5 |
| 3,495,374 | 2/1970 | Ebbers et al. | 414/794.3 |
| 3,585,777 | 6/1971 | Pesch | 53/157 X |
| 3,947,017 | 3/1976 | Seragnoli | 414/797.8 X |
| 4,420,362 | 12/1983 | Valimont et al. | 414/789.5 X |
| 4,618,055 | 10/1986 | Porcelli | 414/790.3 X |
| 4,674,935 | 6/1987 | Feliks et al. | 414/797.8 |
| 4,753,564 | 6/1988 | Pearce et al. | 414/789.5 X |
| 4,764,074 | 8/1988 | Postigo | 414/927 X |
| 4,778,323 | 10/1988 | Salts | 414/927 X |
| 4,824,306 | 3/1989 | Stevenson | 414/789.6 X |

FOREIGN PATENT DOCUMENTS

| | | | |
|---|---|---|---|
| 2143498 | 3/1973 | Fed. Rep. of Germany | 53/263 |

OTHER PUBLICATIONS

Modern Packaging, "1 Problem 3 Solutions", 1/1970, p. 76.

*Primary Examiner*—Michael S. Huppert
*Assistant Examiner*—Boris Milef
*Attorney, Agent, or Firm*—Cushman, Darby & Cushman

[57] ABSTRACT

The equipment is installed between a device by which single commodities are arranged into groups of parallelepiped shape, having one or more layers, and an in-line machine unit by which the groups are to be handled. Proceeding toward the machine unit, each group is supplemented with one or more distance pieces of given thickness, positioned parallel with the layered commodities, in order to compensate for any variation in depth of the group attributable to dimensional variations in the single commodity, and thus to avoid any modification or replacement of the machine unit's working parts that would otherwise become necessary.

6 Claims, 2 Drawing Sheets

FEED EQUIPMENT FOR SUPPLYING A MACHINE UNIT WITH COMMODITIES ARRANGED IN SUBSTANTIALLY PARALLELEPIPED GROUPS

BACKGROUND of the INVENTION

The invention relates to equipment for feeding substantially parallelepiped groups of commodities to an in-line machine unit.

Such equipment is directed specifically though by no means exclusively toward the tobacco industry, the parallelepiped groups of commodities being, for example, packs of cigarettes, and the power machine being one or a number of typical wrapping units by which the parallelepiped is ultimately packaged.

Conventionally, the single packs of cigarettes are enveloped in a transparent cellophane wrapper by a relative machine unit, then gathered together into groups of parallelepiped shape consisting of a given number of individual packs. Packs emerging from the cellophane wrapping unit are formed into groups, most of which have two stacked layers, each of which is made up of a given number of single packs arranged side by side, i.e. with their narrower longitudinal surfaces in flush contact one with the next.

The group thus composed is fed into a further wrapping unit that will either envelop it in a single sheet of paper, or box it into a precreased folding carton.

Additional units may also be utilized, located further downline, to envelop the package or carton in an outer transparent wrapper.

In the event of there being a variation in the dimensions of the pack of cigarettes in production, all machines down-line of the cellophane wrapping unit have to be adapted accordingly by replacement of their relevant working parts. However, when such variations happen to exceed given limits, adaptation by replacement of parts no longer suffices, and it becomes necessary to replace the entire machine unit performing each operation. Such will be the case, for example, when passing from the manufacture of regular cigarettes (approx 0.30"in diameter) to the manufacture of super slims (approx 0.15"); this is a step involving a marked reduction in the depth of the individual pack, and, clearly enough, in the relative dimension of the final package, given that this is a multiple of the individual dimension.

SUMMARY OF THE INVENTION

Accordingly, an object of the invention is to provide feed equipment for parallelepiped groups of commodities designed such that the machine units supplied by it will be able to handle groups of commodities of varying depth without any difficulty, and more especially, without any need to adapt key parts, or indeed to utilize replacement units when the dimensions of the commodities being packaged are intentionally changed.

In general terms, the object of the invention is one of embodying equipment with features that are able to enhance the flexibility of plant designed for handling substantially parallelepiped groups of commodities.

The feed equipment disclosed serves to supply a machine unit with commodities arranged in groups of substantially parallelepiped shape, and utilizes an intermittently driven conveyor to index such groups, each group being made up of at least one layer of commodities, toward the machine in question. An essential feature of equipment according to the invention is that it comprises a dispensing device by which flat distance pieces of given thickness are associated with each group of commodities, disposed parallel to the formed layer, as it proceeds along the conveyor.

Adopting such an expedient, it becomes possible to locate at least one distance piece between two or more layers of slim packs during the step in which one layer is stacked on another, to the end that the ultimate dimensions of the package or carton can be made identical, or almost identical, to those of a package or carton of regular size cigarettes.

A first advantage of the invention is that the stated objects are achieved without affecting the regular cigarette manufacturing process in any way whatsoever.

A further advantage of the invention is that the distance piece, positioned between as-yet unwrapped layers of commodities, provides a separating medium capable of preventing any damage that might occur to the packs through rubbing or friction.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
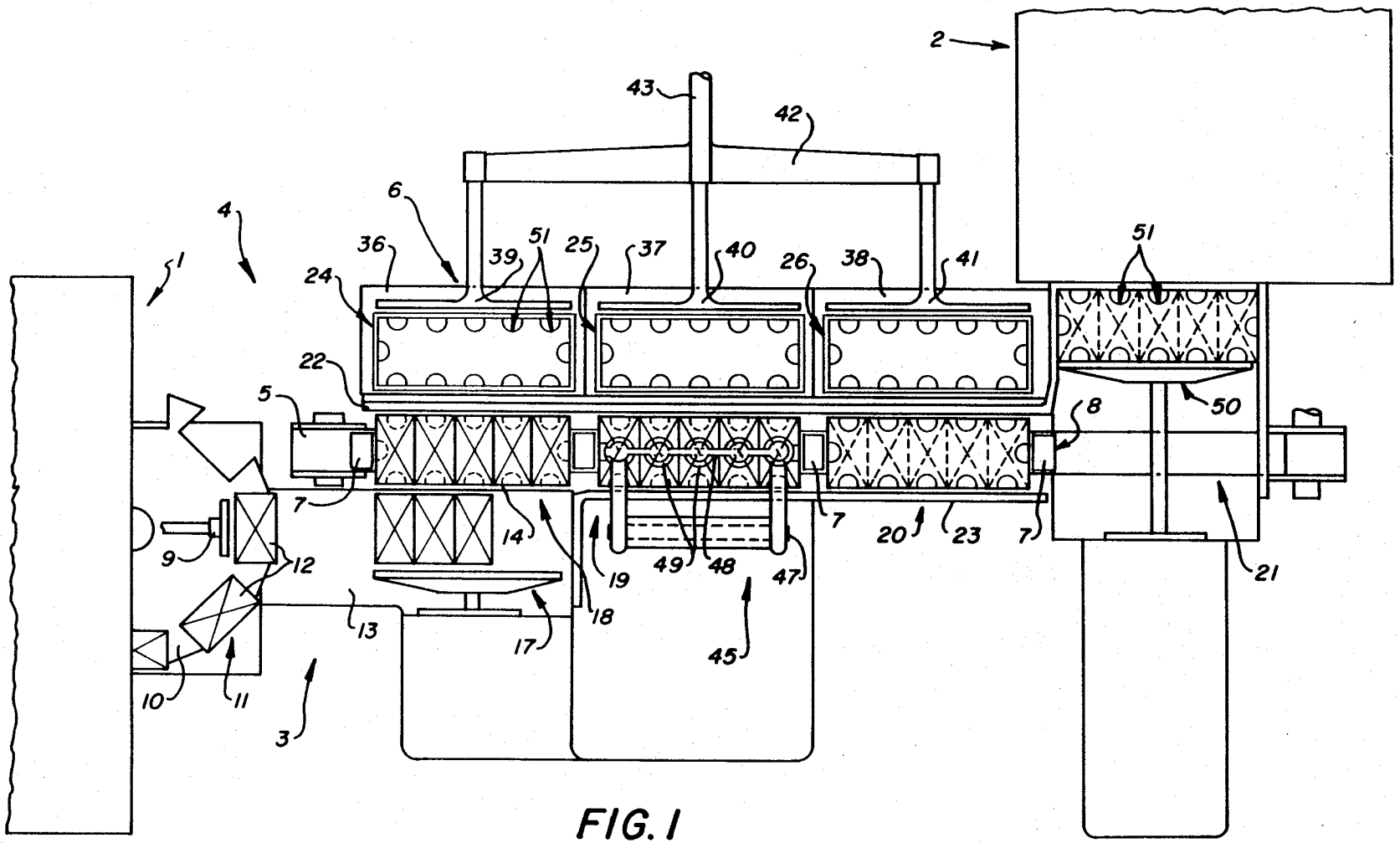
FIG. 1 is a plan of plant incorporating the equipment according to the invention.
Figure 2:
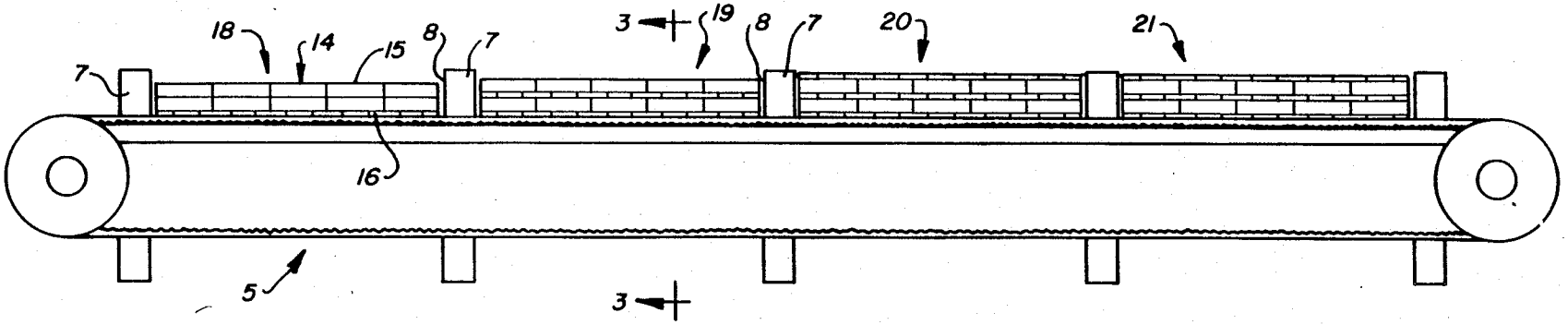
FIG. 2 is a side elevation of the conveyor forming part of equipment according to the invention.

Referring to FIGS. 1 and 2 of the above drawings, 1 denotes a unit, in its entirety, by which single commodities such as packs of cigarettes are wrapped in cellophane; 2 similarly denotes a further unit by which groups of such commodities are wrapped, and 3 denotes a device by which packs emerging from the cellophane wrapping unit 1 are formed into groups.

4 denotes equipment serving to feed the formed groups into the relative wrapping unit 2. According to the invention, such equipment consists in an intermittently driven conveyor 5, and a device 6 for dispensing and positioning flat distance pieces, the conveyor having a plurality of regularly spaced projections 7 that serve to create a given number of compartments 8.

The device 3 by which single packs are formed into groups comprises a reciprocating horizontal push rod 9 and an indexing wheel 10. At each indexed step, a stack 11 of two packs 12 in depth is distanced from the wheel by the push rod 9 and transferred onto a horizontal table 13. At every fifth stroke of the rod, a group 14 of ten packs accumulates on the table 13, made up of two layers 15 and 16 of five packs each, one layer lying flat on the other, with the packs of each layer in mutual contact on either side by way of their narrower longitudinal surfaces.

The position occupied by the group 14 of packs 12 on the table 13 lies in the path of a horizontal push rod 17 that reciprocates at right angles to the conveyor 5. Each forward stroke of the push rod 17 transfers one group 14 of packs onto the conveyor 5, positioning it in one of the compartments 8 waiting in readiness at a first station denoted 18. Once on the conveyor 5, each group 14 is indexed through a succession of further stations 19, 20 and 21, held in position throughout, internally of the respective compartment 8, by vertical fences 22 and 23 disposed parallel with the conveyor 5 on either side (FIG. 1).

Figure 3:
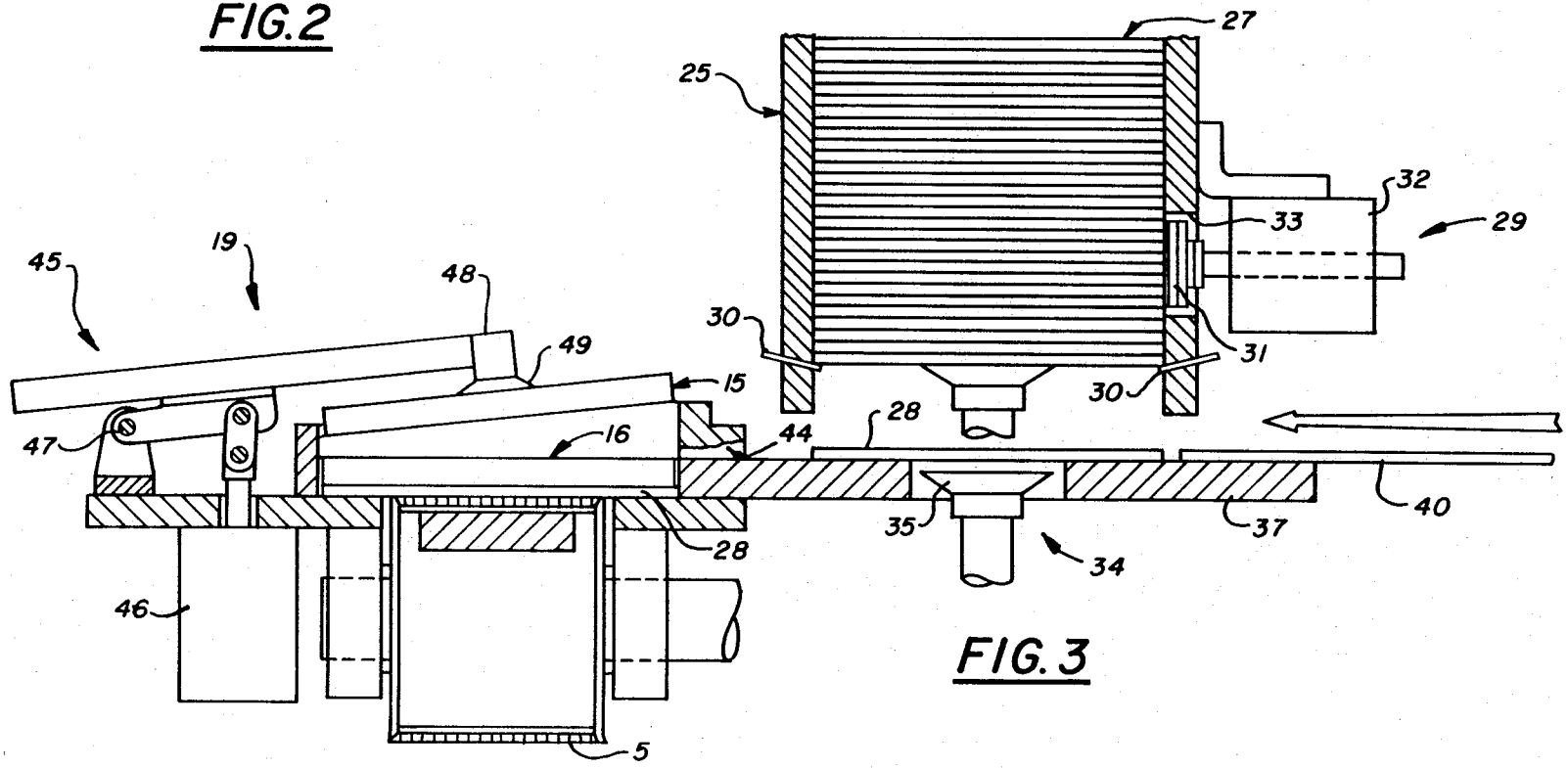
FIG. 3 is a section taken through III—III in FIG. 2, showing a detail of the equipment on larger scale, and partly in section.

24, 25 and 26 denote three substantially upright magazines located at the side of the conveyor 5 opposite from the table 13, which magazines are aligned with the first three stations 18, 19 and 20 respectively; each magazine contains a column 27 of flat distance pieces, preferably being cardboard leaves 28 of a given thickness (see also FIG. 3).

29 denotes a device, in its entirety, associated with each magazine 24, 25 and 26, that serves to dispense single leaves 28 from the bottom of the column 27. Each dispensing device 29 (the device of FIG. 3, shown by way of example, is that associated with the middle magazine 25) comprises fixed bearer means 30, serving to hold the column 27 suspended internally of the magazine 24, 25, 26, and above the fixed bearer means, clamp means 31 that can be moved by respective actuator means 32 between a engaged position, whereby contact is made with the column 27 of cardboard leaves through an opening 33 in one wall of the magazine, and a disengaged position.

Each dispensing devices 29 also incorporates pneumatic extraction means 34 comprising suction heads 35 that connect with a source of negative pressure (not illustrated) and are capable of movement, produced by respective actuator means, between a raised position in which contact is made with the bottom leaf of the column 27, and a lowered position.

36, 37 and 38 denote horizontal plates located one beneath each magazine on a level coinciding with the lower position of the sucker. More exactly, the plates occupy progressively higher levels along the path of the conveyor 5, offset one in relation to the next by an amount substantially equal to the depth of one pack 12.

39, 40 and 41 denote horizontal push rods lying one between each magazine 24, 25 and 26 and its relative plate 36, 37 and 38, and operating at right angles to the conveyor 5. The three push rods 39, 40 and 41 are yoked together, rigidly interconnected by a crossbar 42 fixed to a drive shaft 43, and offset in height one from the next in such a way as to lie substantially in contact with the three respective horizontal plates 36, 37 and 38.

44 denotes an opening created in the fence 22 on the magazine side of the conveyor, lying in the path of each push rod 39, 40 and 41 (the opening visible in FIG. 3 is that relative to the middle rod 40), which affords a free passage to the single cardboard leaves 28.

45 denotes a lifting device, in its entirety, installed at the second station 19 and facing the relative magazine 25, the operation of which will shortly be described. The device 45, operated by an actuator denoted 46, is capable of rocking about a pivot 47 in alternation and comprises a rail 48, lying above the station 19 and running parallel to the conveyor 5, with which pneumatic pick-up means are associated that are made up of five suction heads 49 connected with a source of negative pressure (not illustrated).

In the description of the equipment's operation that now follows, reference is made first to the various steps undergone by a single group 14 of packs 12 between entering and leaving the conveyor.

With a group 14 of packs forming on the table 13 in the manner already described, the first of the three yoked rods 39 pushes a cardboard leaf 28 into the compartment 8 occupying the first station 18, whereupon the push rod denoted 17 strokes forward, transferring the entire group 14 onto the leaf 28 just positioned.

The group 14 is now indexed through one step into the second station 19, and with the conveyor 5 at standstill, the lifting device 45 pivots downward to bring the suction heads 49 into contact with the five packs 12 of the top layer 15.

With suction generated and the rail 48 lifted, the top layer 15 of the group separates from the bottom layer 16, enabling the relative yoked push rod 40 to position a cardboard leaf 28 on the bottom layer 16; this accomplished, the suction heads 49 will be deactivated through the operation of valve means (not illustrated) controlling the negative pressure source, with the result that the top layer 15 flops back down onto the bottom layer 16.

The conveyor 5 indexes again, bringing the group into the third station 20, and a third cardboard leaf 28 is pushed onto the top layer 15 of packs by the relative rod 41.

A further step indexed by the conveyor 5 brings the group 14 into the final station 21, from where it is fed ultimately into the wrapping unit 2 by a push rod denoted 50.

The operation of the dispensing devices 29 is identical at each of the three stations, the single cardboard leaves 28 being supplied to the respective push rods 39, 40 and 41 in the manner that will now be described, with reference to the magazine 25 shown in FIG. 3.

At the moment in which the extraction means 34 enter into contact with the bottom leaf 28 of the relative magazine, the clamp means 31 are distanced from the column 27 in order to allow the full weight of the magazine's contents to rest freely on the bearer means 30, and indeed on the suction heads 35, to which the bottom leaf now becomes firmly attached.

The clamp means 31 are now moved back through the opening 33 to engage the leaves 28, as in FIG. 3; with the leaves thus held between the clamp means 31 and the opposite wall of the magazine 25, the upper portion of the column remains supported, and there is no danger, when the suction heads 35 descend with the one cardboard leaf 28 required, that further leaves may also be forced out of the magazine by the weight of the entire column. Each time the clamp means 31 retract, the top part of the column 27 will descend by an amount substantially equal to the thickness of one of the cardboard leaves 28, so as to take up the space left by the last removal of the bottom leaf.

It will be seen that, on completion of the various steps accomplished by the equipment 4, the group 14 of commodities runs out having undergone a correction of its depth dimension by addition of the three distance pieces 28, and can thus be handled by the wrapping unit 2 without there being any need for modification of the unit itself.

For simplicity's sake, reference has been made in the specification thus far to a single group 14 of commodities -viz, initial formation, addition of three cardboard distance pieces disposed parallel to the layers of which it composed, and transfer into the final wrapping unit 2. In effect, however, the yoked push rods 39, 40 and 41 operate in concert, and with each step indexed by the conveyor 5, three leaves 28 will be transferred simultaneously from the bottom of the relative magazines into the three successive compartments 8 alongside. More exactly, a first leaf 28 is pushed by the first rod 39 across the first plate 36 and onto the vacant surface of the conveyor 5, a second leaf 28 is pushed by the second rod 40 across the second plate 37 onto the bottom layer 15 of a first group 14, and a third leaf 28 is pushed by the third rod 41 across the third plate 38, onto the top layer 15 of a second group 14.

Accordingly, with each single step indexed by the conveyor 5, one group 14 of commodities reaches the final station 21, complete with its set of three distance pieces 28, in readiness for transfer to the wrapping unit 2.

In alternative embodiments of the invention, the number of magazine push rods incorporated into the equipment 4 might be varied according to the depth of parallelepiped best suited to the in-line machine unit 2, to the number of layers making up the group of commodities, or to the thickness of the distance pieces themselves.

In the event that the increase in depth required by the in-line machine 2 is less than that produced by the equipment in a given situation, the number of magazine push rods will be reduced from three to two or one, according to necessity, and the remainder removed or made idle.

It will be observed that, besides producing an increase in depth, a distance piece 28 positioned between two layers 15 and 16 of a group can also serve to keep the commodities separate, especially commodities on which no previous individual wrapping operation has been effected.

In the embodiment illustrated, the cardboard leaves 28 will be seen to have an outline having notches 51 of substantially half-round shape, the purpose of which is to assist the user in laying hold on and extracting the single packs 12 from the package or carton fashioned by the wrapping unit 2.

What is claimed:

1. Feed equipment for supplying a machine unit with commodities arranged in substantially parallelepiped groups, comprising:

an intermittently driven conveyor by which groups, each having at least one layer formed from the commodities, are carried toward the machine unit; and a device by which flat distance pieces, each having a given thickness, are dispensed and associated with the groups, positioned parallel with the formed layer, as they proceed on the conveyor toward the machine unit, said device comprising at least two push rods that are rigidly interconnected and installed at dissimilar heights in relation to said conveyor.

2. Equipment as in claim 1, wherein:

said device comprises:

a respective magazine associated with each said push rod for containing a plurality of the flat distance pieces stacked one on top of the other; and means for extracting the flat distance pieces singly from the bottom of the respective magazines and positioning such pieces in the paths of the respective push rods.

3. Equipment as in claim 1, designed to feed groups in which each group is made up of at least two layers of commodities including an uppermost layer and a bottom layer, further including:

lifting means, located along the path of the conveyor in alignment with said device for raising the uppermost layer of each group, so as to permit of positioning a flat distance piece beneath the raised commodities.

4. Equipment as in claim 3, wherein:

said device comprises three rigidly interconnected push rods installed at three progressively increasing heights along the path of the conveyor, such that one said rod lies on a level with the conveyor, another said rod on a level with the bottom layer of commodities and in alignment with the lifting means, and the remaining said rod on a level with the uppermost layer of commodities.

5. Equipment as in claim 3, wherein:

the lifting means are mounted so as to be capable of rocking movement and comprise pneumatic means by which the commodities making up the uppermost layer of the group are picked up.

6. Equipment as in claim 2, wherein:

the means by which the flat distance pieces are extracted singly form the bottom of each magazine comprise:

means positioned at the bottom of the respective magazine for bearing the weight of the stacked distance pieces;

means located above the respective bearing means for holding the stacked distance pieces stable internally of the respective magazine and being capable of movement between a non-operative position, in which no contact is made with the stacked distance pieces, and a position of contact with the stacked distance pieces, which position of contact is assumed each time a distance piece is removed from the bottom of the respective magazine by the respective extracting means.

* * * * *